US005671843A

United States Patent [19]

Sutter

[11] Patent Number: 5,671,843

[45] Date of Patent: Sep. 30, 1997

[54] GOLF CLUB ORGANIZING ASSEMBLY HAVING STRAIGHT AND CURVED MEMBERS FOR GOLF CLUB CARRYING BAG

[76] Inventor: James L. Sutter, 32439 Inverness Dr., Evergreen, Colo. 80439

[21] Appl. No.: 710,866

[22] Filed: Sep. 23, 1996

Related U.S. Application Data

[60] Provisional application No. 60/008,566, Dec. 13, 1995 and provisional application No. 60/010,989, Feb. 1, 1996.

[51] Int. Cl.[6] ..... A63B 55/00

[52] U.S. Cl. ..... 206/315.6; 206/315.3

[58] Field of Search ..... 206/315.3, 315.6; 220/528, 555

[56] References Cited

U.S. PATENT DOCUMENTS

| | | | |
|---|---|---|---|
| 1,798,638 | 3/1931 | Stone et al. . | |
| 2,568,810 | 9/1951 | Kish, Jr. | 150/1.5 |
| 3,331,419 | 7/1967 | Bencriscutto | 206/315.6 |
| 4,172,484 | 10/1979 | Henning | 150/1.5 B |
| 4,311,178 | 1/1982 | Kennedy | 150/1.5 R |
| 4,596,328 | 6/1986 | Solheim | 206/315.6 |
| 4,691,823 | 9/1987 | Pape | 206/315.6 |
| 4,753,344 | 6/1988 | Antonious | 206/315.3 |
| 4,768,650 | 9/1988 | Chancellor, Jr. | 206/315.3 |
| 4,844,253 | 7/1989 | Reimers | 206/315.6 |
| 5,123,531 | 6/1992 | Beretta | 206/315.3 |
| 5,125,507 | 6/1992 | Graziano, Jr. | 206/315.6 |
| 5,392,907 | 2/1995 | Blanchard et al. | 206/315.6 |
| 5,421,454 | 6/1995 | Chern | 206/315.6 |
| 5,431,278 | 7/1995 | Gretz | 206/315.6 |
| 5,447,228 | 9/1995 | Hodgson, III | 206/315.3 |
| 5,450,958 | 9/1995 | Shin | 206/315.6 |
| 5,474,176 | 12/1995 | Schenkkan | 206/315.6 X |
| 5,501,328 | 3/1996 | Keller et al. | 206/315.6 |
| 5,518,113 | 5/1996 | Boone | 206/315.6 |
| 5,573,112 | 11/1996 | Kim | 206/315.6 |

FOREIGN PATENT DOCUMENTS

| | | | |
|---|---|---|---|
| 2130102 | 5/1984 | United Kingdom | 206/315.6 |

OTHER PUBLICATIONS

Crospete® Organizer advertisement—Aim Golf, date unknown.

*Primary Examiner*—Allan N. Shoap
*Assistant Examiner*—Christopher J. McDonald
*Attorney, Agent, or Firm*—Flanagan & Flanagan

[57] ABSTRACT

A golf club organizing assembly includes a plurality of straight members attached at opposite ends to and extending between spaced portions of an open upper end of a carrying bag and a plurality of curved members attached at opposite ends to and extending between spaced portions of the open upper end of the carrying bag. The curved members cross the straight members and together define a plurality of slots for receiving golf clubs in the bag. The straight members are in substantially parallel relation to one another. The curved members are in substantially concentric relation to one another. The assembly may further include a continuous round member attachable to and retrofitable at the open upper end of the carrying bag where the straight and curved members are attached at their opposite ends to and extend between spaced portions of the round member and are not directly attached to the open upper end of the bag. The assembly may also be an integral part of the carrying bag where the round member is an integral part of the open upper end of the bag.

30 Claims, 2 Drawing Sheets

GOLF CLUB ORGANIZING ASSEMBLY HAVING STRAIGHT AND CURVED MEMBERS FOR GOLF CLUB CARRYING BAG

This application claims the benefit of U.S. provisional application Ser. Nos. 60/008,566 filed Dec. 13, 1995, and 60,010,989, filed Feb. 1, 1996.

BACKGROUND OF THE INVENTION

1. Field of the Invention

The present invention generally relates to arranging golf clubs in carrying bags and, more particularly, is concerned with a golf club organizing assembly having straight and curved members creating a plurality of slots for receiving the shafts of golf clubs in a carrying bag.

2. Description of the Prior Art

Golf clubs are often carried in a sleeve-like bag designed for that purpose. As seen in a top plan view in FIG. 1 and in a side elevational view in FIG. 2, a basic prior art golf club carrying bag 10 has a tubular sidewall 12 open at an upper end 12A and closed at a lower end 12B by a bottom end wall 14. An interior of the bag 10 defines a cavity 16 in which the golf clubs are stored vertically with their handgrip ends down so that the heads of the clubs extend above the open upper end 12A of the bag 10.

As is well-known, golf clubs generally differ from one another in terms of lengths of their shafts, shapes and sizes of their heads, and angles at which their golf ball striking surfaces extend relative to a horizontal plane. Golfers select one of the clubs to use for any given stroke depending on the particular placement of the ball whether in the rough or on the tee, fairway or green and the distance of the ball from the hole. As a result, many golfers prefer to maintain their clubs in their bag in some organized fashion so that they can quickly locate and replace the one club they have selected to use for the particular stroke at hand.

The basic design of the prior art golf bag 10, shown in FIGS. 1 and 2, does not provide a means to organize the clubs in the bag 10. As the bag 10 is moved and jostled about during a round of play, the clubs will bump each other and move around in the bag 10 relative to one another and will be disorganized causing the golfer to constantly search for the selected club. The bumping of the clubs against one another may also result in wear on the handgrip surfaces and dings and nicks on the club heads. In an effort to address these problems with the basic prior art bag 10, a variety of prior art approaches to bag design for better arranging and organizing golf clubs in the bags have occurred over the years.

In a first prior art approach, as shown in a top plan view in FIG. 3, the bag 10 at the open upper end is provided with a front-to-back extending rigid central bar 18 and a pair of front-to-back spaced apart rigid cross bars 20, 22. The bars 18 to 22 are fixedly attached at opposite ends to the upper end 12A of the bag sidewall 12. In some cases, divider panels of cloth or plastic sheets are also provided, being attached to and extending downward from the cross bars 20, 22 to the bottom wall 14 of the bag 10 forming three separate compartments. These bars 20, 22 and panels serve to spread and separate groups of clubs from one another. Nevertheless, clubs within a group can still move around and bump one another such that they remain substantially disorganized and subject to damaging contacts.

In a second prior art approach, as shown in a top plan view in FIG. 4, a plurality of plastic elongated tubes 24, each for receiving one of the clubs, are inserted in the club carrying cavity 16 of the bag 10 and arranged in a side-by-side relation substantially filling the cavity 16. While the tubes 24 will generally maintain the clubs in a desired organized arrangement, they may scuff and wear the handgrips and over time tend to bend and split from golfers repeatedly inserting and pulling out the clubs at various angles relative to the tubes 24. Also, the tubes 24 will frequently be pulled out of the bag 10 with the clubs.

In a third prior art approach, as shown in a top plan view in FIG. 5, the bag 10 is provided with a plurality of peripheral elongated compartments 26 formed about the inside perimeter of the bag sidewall 12 by a large flexible panel 28 which is arranged in a serpentine configuration to define side-by-side, bell-shaped wall portions 30 projecting from the sidewall 12 of the bag 10 toward the center of the bag 10 and attached to the bag sidewall 12 along narrow portions 32 of the flexible panel 28 which extends between the bell-shaped wall portions 30. This approach also has two separate panel pieces 34 attached at their opposite vertical edges to the bag sidewall 12 and extending across the cavity 16 of the bag 10 defining four central elongated compartments 36 for receiving golf clubs and other accessories such as a ball retriever and/or an umbrella. A representative example of this approach is a golf club organizer product sold under a U.S. registered trademark "Crospete" owned by AIM Golf of Santa Fe Springs, Calif. While the compartments 26 will maintain clubs in an organized arrangement, they have a relatively tight fit creating difficulty in removing and returning the clubs from and back to the compartments 26 and causing increased wear to both handgrips and the wall portions 30 which may result in premature deterioration thereof. Furthermore, the peripheral arrangement of the compartments 26 provides a fixed pattern which bears no logical relationship to how most golfers would desire to organize their clubs in the bag.

Consequently, a need remains for an assembly for arranging golf clubs in a carrying bag which provides a solution to the aforementioned problems in the prior art without introducing any new problems in place thereof.

SUMMARY OF THE INVENTION

The present invention provides a golf club organizing assembly which is designed to satisfy the aforementioned need. The golf club organizing assembly of the present invention has straight and curved members creating a plurality of slots for receiving the shafts of golf clubs in a carrying bag. A principal advantage of the curved members over the straight members is that the curved members provide more equalization in the process of forming the slots and dividing up the available storage volume of the bag. The arrangement of the slots in relation to one another also minimizes contact between adjacent clubs and thereby reduces the wear on the handgrips and number of dings and nicks on the club heads.

Accordingly, the present invention is directed to a golf club organizing assembly which comprises: (a) a plurality of straight members interconnected at opposite ends to and extending between spaced portions of an open upper end of a carrying bag; and (b) a plurality of curved members interconnected at opposite ends to and extending between spaced portions of the open upper end of the carrying bag. The curved members cross the straight members and together define a plurality of slots for receiving therethrough the golf clubs into the carrying bag.

More particularly, the straight and curved members each number three and form fourteen slots. Each slot is intended to receive one club. The straight members are in substantially parallel relation to one another. The curved members are in substantially concentric relation to one another.

The assembly may further include a continuous round member attachable to and retrofitable at the open upper end of the carrying bag such that the straight and curved members are attached at their opposite ends to and extend between spaced portions of the round member and are not directly attached to the open upper end of the bag. The assembly may also be an integral part of the carrying bag where the straight and curved members are attached at their opposite ends to and extend between spaced portions of a continuous round member which is an integral part of the open upper end of the bag.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
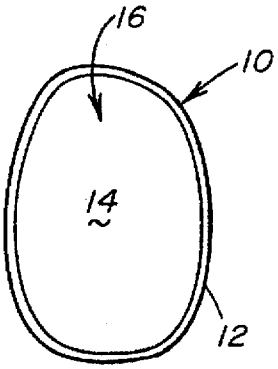
FIG. 1 (PRIOR ART)
FIG. 1 is a top plan view of a prior art golf bag having a basic design as described earlier.
Figure 3:
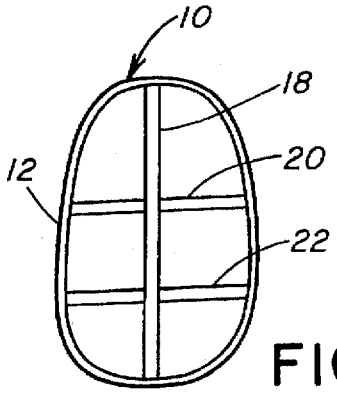
FIG. 3 (PRIOR ART)
FIG. 3 is a top plan view of the first prior art approach for arranging clubs in a golf bag as described earlier.
Figure 4:
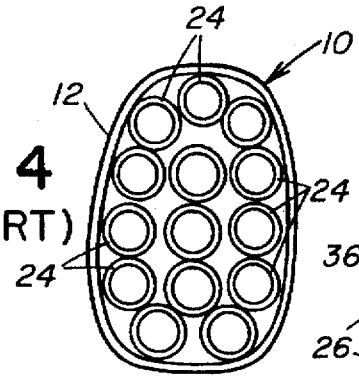
FIG. 4 (PRIOR ART)
FIG. 4 is a top plan view of the second prior art approach for arranging clubs in a golf bag as described earlier.
Figure 5:
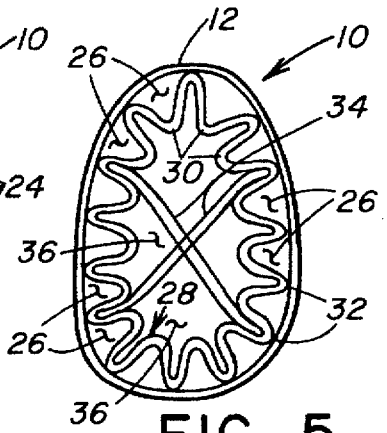
FIG. 5 (PRIOR ART)
FIG. 5 is a top plan view of the third prior art approach for arranging clubs in a golf bag as described earlier.
Figure 2:
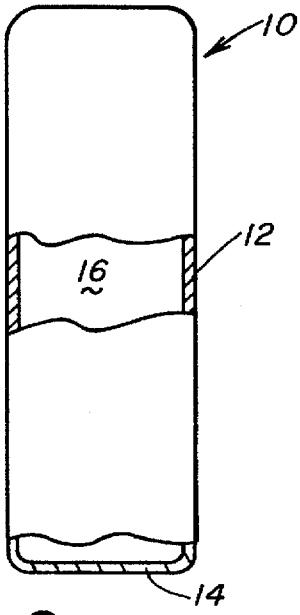
FIG. 2 (PRIOR ART)
FIG. 2 is a side elevational view of the prior art golf bag shown in FIG. 1 with portion of its sidewall broken away.

Referring to the drawings and particularly to FIGS. 6 to 9, there is diagrammatically illustrated a golf club organizing assembly, generally designated 40, of the present invention as it would be provided in a conventional golf club carrying bag 10. As described earlier in the background of the invention and shown in FIGS. 1 and 2, the golf bag 10 has the tubular sidewall 12 open at the upper end 12A and closed at the lower end 12B by the bottom end wall 14. The interior of the bag 10 defines the cavity 16 in which the golf clubs are stored vertically with their handgrip ends down so that the heads of the clubs extend above the open upper end 12A of the bag 10.

The golf club organizing assembly 40 defines an array or arrangement of locations for receiving clubs in the golf bag 10 which are designed to shape and distribute the storage space available in the golf bag 10 in a manner which bears a direct logical relationship to how most golfers would desire to organize their clubs in the bag. The arrangement of clubs by the assembly 40 also minimizes contact between adjacent clubs and thereby reduces the wear on the handgrips and number of dings and nicks on the club heads.

Basically, the golf club organizing assembly 40 includes a plurality of relatively (or approximately) straight members 42 and relatively (or approximately) curved members 44 for attachment to the golf club carrying bag 10. The straight members 42 are interconnected at opposite ends 42A, 42B to and extend between spaced front and rear portions of the open upper end 12A of the sidewall 12 of the bag 10. The curved members 44 are interconnected at opposite ends 44A, 44B to and extend between spaced opposite side portions of the open upper end 12A of the sidewall 12 of the bag 10. The curved members 44 cross the straight members 42 and together define a plurality of slots 46 defining the aforementioned array of locations for receiving therethrough the shafts of golf clubs in the bag 10. Including curved members 44 instead of only all straight members 42 in forming the slots 46 in the bag 10 provides more effective shaping, division and distribution and thus equalization of the available storage space or volume of the bag 10 for receiving the various clubs therein.

Figure 6:
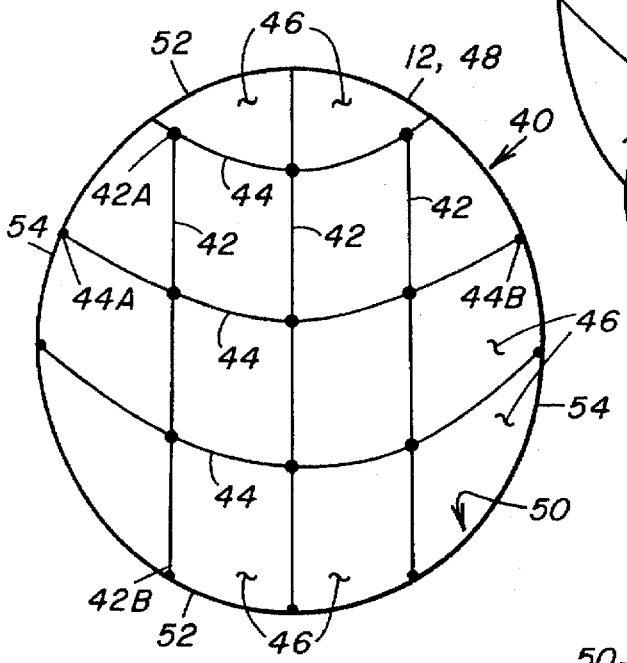
FIG. 6 is a diagrammatic top plan view of a first configuration of the golf club organizing assembly of the present invention.
Figure 7:
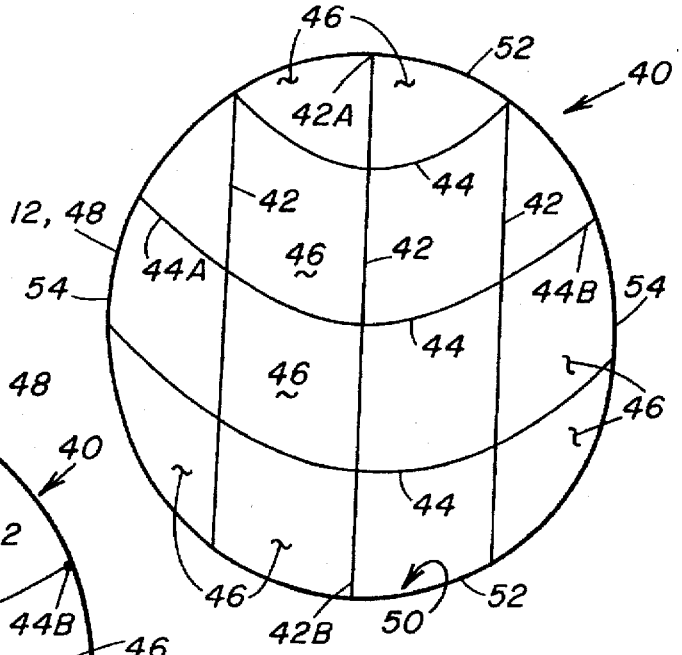
FIG. 7 is a diagrammatic top plan view of a second configuration of the assembly.
Figure 8:
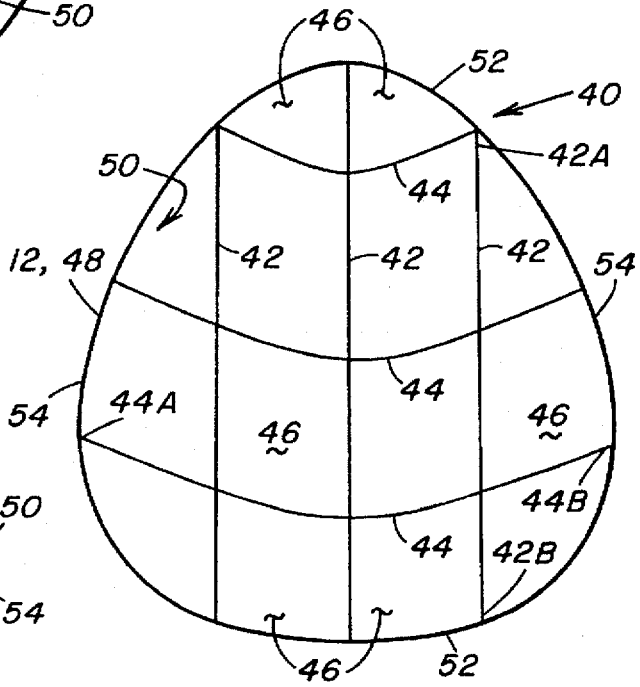
FIG. 8 is a diagrammatic top plan view of a third configuration of the assembly.
Figure 9:
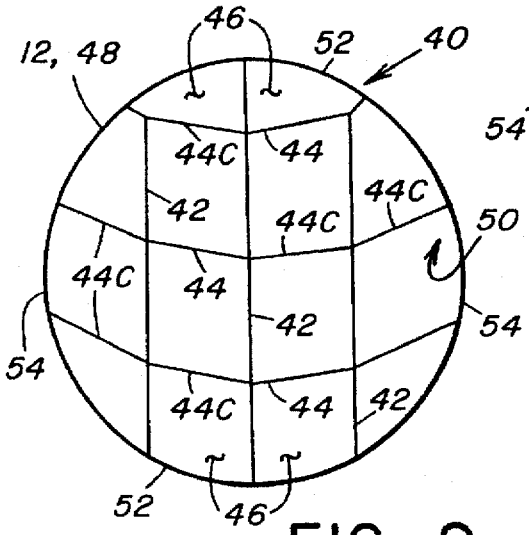
FIG. 9 is a diagrammatic top plan view of a fourth configuration of the assembly.

The straight members 42 and the curved members 44 each are preferably three in number and form fourteen slots 46, though the straight and curved members 42, 44 can be provided in other suitable numbers and form other suitable numbers of slots 46. Each slot 46 is intended to receive one golf club. The straight members 42 are disposed in substantially parallel relation to one another. The curved members 44 are disposed in substantially concentric relation to one another. As shown in FIGS. 6 to 9, the straight and curved members 42, 44 can be provided in different configurations being slightly modified from one another. FIG. 6 depicts the outer two straight members 42 interconnected to the sidewall 12 via connection at their forward ends to the forward one of the curved members 44, whereas FIG. 7 depicts the outer two straight members 42 along with the opposite ends of the forward curved member 44 attached directly to the sidewall 12 of the bag 10. FIG. 8 depicts the curved members 44 having a generally chevron or shallow V shape whereas FIG. 9 depicts the curved members 44 made up of an overall curved arrangement of straight interconnected segments 44C.

The straight and curved members 42, 44 are preferably comprised of a substantially semi-flexible material but can be of any other suitable material. Also, the members 42, 44 are preferably covered by a soft fabric material but need not be and can be covered by any other suitable material.

The golf club organizing assembly 40 can further include a continuous round member 48 attachable to and retrofitable at the open upper end 12A of the sidewall 12 of the bag 10. The round member 48 encircles a space 50 and has pairs of first and second circumferentially and oppositely spaced portions 52, 54. In this embodiment, the straight members 42 are disposed in the space 50 of the round member 48 and are attached at opposite ends 42A, 42B to and extend between the first opposite spaced portions 52 of the round member 48. The curved members 44 are also disposed in the space 50 of the round member 48 and are attached at opposite ends 44A, 44B to and extend between the second opposite spaced portions 54 of the round member 48. The first spaced portions 52 of the round member 48 are located at the front and back of the open upper end 12A of the sidewall 12 of the bag 10 with reference to a shoulder strap (not shown)

attached at the back thereof. The second spaced portions 54 of the round member 48 are located at sides of the open upper end 14 of the bag 10 with reference to the shoulder strap. The golf club organizing assembly 40 may also be an integral part of the bag 10 where the straight and curved members 42, 44 are attached at their opposite ends to and extend between the aforementioned spaced portions of the round member 48 which can be an integral part of the open upper end 12A of the bag sidewall 12.

Furthermore, the straight and curved members 42, 44 can each be in the form of a strap having a length extending transversely across the open upper end 12A of the sidewall 12 of the bag 10, a depth extending longitudinally in the cavity 16 of the bag 10, and a thickness extending between opposite surfaces on the members. The length of each member 42, 44 is greater than the depth thereof. The depth of each member 42, 44 is greater than the thickness thereof. Each straight and curved member 42, 44, or any one or more thereof, may also be in the form of a cylindrical elongated rod having a diameter and a length extending transversely across the open upper end 12A of the bag 10 greater than the diameter thereof. Each straight and curved member 42, 44 may also have any other suitable configuration. The straight and curved members 42, 44 may also extend above or below one another or may be secured to one another by any suitable means. By way of example, the straight and curved member 42, 44 may intersect one another by one of them passing through a slit in the other and being stitched together at their points of intersection. Any one or more of the straight and curved members 42, 44 may also be removable.

Figure 10:
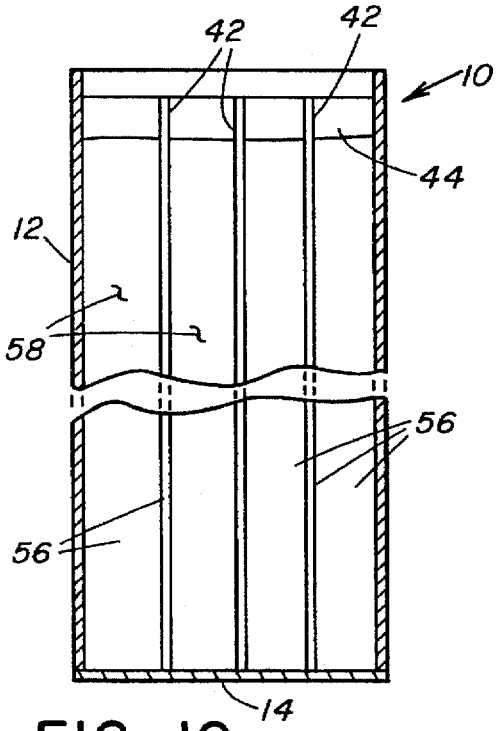
FIG. 10 is a foreshortened partially sectional side elevational view of the golf bag showing divider panels employed in the bag with the assembly.

Referring now to FIG. 10, one or more of the straight and curved members 42, 44 may be employed with at least one and preferably a plurality of vertical dividers 56 disposed and extending between the open upper end 12A of the sidewall 12 of the carrying bag 10 and the bottom wall 14 of the bag 10 so as to provide full-length slots 58 for receiving golf clubs in the bag 10. The vertical dividers 56 may be comprised of a substantially semi-flexible material but can be of any other suitable material and is covered by a soft fabric material but need not be and can be covered by any other suitable material and may be removable.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A golf club organizing assembly for receiving golf clubs in a carrying bag, said assembly comprising:

(a) a plurality of substantially straight members interconnected at opposite ends to and extending between first opposite spaced portions of an open upper end of a golf club carrying bag; and (b) a plurality of substantially curved members interconnected at opposite ends to and extending between second opposite spaced portions of the open upper end of the carrying bag, said curved members crossing said straight members and together defining a plurality of slots for receiving therethrough the golf clubs into the carrying bag.

2. The assembly of claim 1 wherein said straight members are three in number.

3. The assembly of claim 1 wherein said curved members are three in number.

4. The assembly of claim 1 wherein said straight members are in substantially parallel relation to one another.

5. The assembly of claim 1 wherein said curved members are in substantially concentric relation to one another.

6. The assembly of claim 1 wherein said curved members have a generally shallow V shape.

7. The assembly of claim 1 wherein said curved members are made up of an overall curved arrangement of straight interconnected segments.

8. The assembly of claim 1 wherein said straight and curved members are comprised of a substantially semi-flexible material.

9. The assembly of claim 1 wherein said straight and curved members include vertical dividers disposed and extending vertically between the open upper end of the carrying bag and a bottom wall of the carrying bag so as to provide full-length slots for receiving golf clubs in the carrying bag.

10. A golf club organizing assembly for receiving golf clubs in a carrying bag, said assembly comprising:

(a) a continuous round member encircling a space and having first opposite spaced portions and second opposite spaced portions and being attachable to an open upper end of a golf club carrying bag;

(b) a plurality of substantially straight members disposed in said space of said round member and being interconnected at opposite ends to and extending between said first opposite spaced portions of said round member; and (c) a plurality of substantially curved members disposed in said space of said round member and being interconnected at opposite ends to and extending between said second opposite spaced portions of said round member, said curved members crossing said straight members and together defining a plurality of slots for receiving therethrough golf clubs into the carrying bag.

11. The assembly of claim 10 wherein said straight members are three in number.

12. The assembly of claim 10 wherein said curved members are three in number.

13. The assembly of claim 10 wherein said straight members are in substantially parallel relation to one another.

14. The assembly of claim 10 wherein said curved members are in substantially concentric relation to one another.

15. The assembly of claim 10 wherein said curved members have a generally shallow V shape.

16. The assembly of claim 10 wherein said curved members are made up of an overall curved arrangement of straight interconnected segments.

17. The assembly of claim 10 wherein said straight and curved members are comprised of a substantially semi-flexible material.

18. The assembly of claim 10 wherein said straight and curved members include vertical dividers disposed and extending vertically between the open upper end of the carrying bag and a bottom wall of the carrying bag so as to provide full-length slots for receiving golf clubs in the carrying bag.

19. The assembly of claim 10 wherein said first opposite spaced portions of said round member are located at a front and back of the open upper end of the carrying bag with reference to a shoulder strap attached at the back thereof.

20. The assembly of claim 10 wherein said second opposite spaced portions of said round member are located at a pair of opposite sides of the open upper end of the carrying bag with reference to a shoulder strap attached at a back thereof.

21. A golf bag assembly for receiving golf clubs therein, said assembly comprising:

(a) a carrying bag including (i) a tubular sidewall defining an elongated cavity and having an open upper end with first opposite spaced portions and second opposite spaced portions, and (ii) a bottom end wall attached to and enclosing a lower end of said tubular sidewall;

(b) a plurality of substantially straight members disposed in said open upper end of said carrying bag and being interconnected at opposite ends to and extending between said first opposite spaced portions of said open upper end of said carrying bag; and (c) a plurality of substantially curved members disposed in said open upper end of said carrying bag and being interconnected at opposite ends to and extending between said second opposite spaced portions of said open upper end of said carrying bag, said curved members crossing said straight members and together defining a plurality of slots for receiving therethrough golf clubs into said carrying bag.

22. The assembly of claim 21 wherein said straight members are three in number.

23. The assembly of claim 21 wherein said curved members are three in number.

24. The assembly of claim 21 wherein said straight members are in substantially parallel relation to one another.

25. The assembly of claim 21 wherein said curved members are in substantially concentric relation to one another.

26. The assembly of claim 21 wherein said curved members have a generally shallow V shape.

27. The assembly of claim 21 wherein said curved members are made up of an overall curved arrangement of straight interconnected segments.

28. The assembly of claim 21 wherein said straight and curved members are comprised of a substantially semi-flexible material.

29. The assembly of claim 21 wherein said first opposite spaced portions of said round member are located at a front and back of the open upper end of the carrying bag with reference to a shoulder strap attached at the back thereof.

30. The assembly of claim 21 wherein said second opposite spaced portions of said round member are located at a pair of opposite sides of the open upper end of the carrying bag with reference to a shoulder strap attached at a back thereof.

* * * * *